US010194728B2

(12) United States Patent
Stephens et al.

(10) Patent No.: US 10,194,728 B2
(45) Date of Patent: Feb. 5, 2019

(54) ATTACHMENT FOR A HAND HELD APPLIANCE

(71) Applicant: Dyson Technology Limited, Wiltshire (GB)

(72) Inventors: Philip Jonathan Stephens, Swindon (GB); Stephen Farrar Smith, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 170 days.

(21) Appl. No.: 15/003,674

(22) Filed: Jan. 21, 2016

(65) Prior Publication Data

US 2016/0206075 A1 Jul. 21, 2016

(30) Foreign Application Priority Data

Jan. 21, 2015 (GB) ..... 1500977.2

(51) Int. Cl.
*A45D 20/12* (2006.01)
*B05B 1/02* (2006.01)

(52) U.S. Cl.
CPC ..... *A45D 20/12* (2013.01); *A45D 20/122* (2013.01); *B05B 1/02* (2013.01)

(58) Field of Classification Search
CPC ..... A45D 20/12; A45D 20/122; B05B 1/02
See application file for complete search history.

(56) References Cited

U.S. PATENT DOCUMENTS

| | | | |
|---|---|---|---|
| 3,943,329 | A | 3/1976 | Hlavac |
| 4,250,902 | A | 2/1981 | Ihara |
| 4,287,673 | A | 9/1981 | Wolter |
| 4,350,872 | A | 9/1982 | Meywald et al. |
| 4,596,921 | A | 6/1986 | Hersh et al. |
| 4,767,914 | A | 8/1988 | Glucksman |
| 5,133,043 | A | 7/1992 | Baugh |
| D350,413 | S | 9/1994 | Feil |
| D352,365 | S | 11/1994 | Hansen et al. |
| 5,378,882 | A | 1/1995 | Gong et al. |
| 5,546,674 | A | 8/1996 | Lange et al. |

(Continued)

FOREIGN PATENT DOCUMENTS

| | | |
|---|---|---|
| CH | 588 835 | 6/1977 |
| CN | 200973446 | 11/2007 |

(Continued)

OTHER PUBLICATIONS

Sutter et al., U.S. Office Action dated Mar. 9, 2017, directed to U.S. Appl. No. 14/339,014; 12 pages.

(Continued)

*Primary Examiner* — Jessica Yuen

(74) *Attorney, Agent, or Firm* — Morrison & Foerster LLP

(57) ABSTRACT

An attachment for a hand held appliance, the attachment having a first wall, and a bung housed within the first wall wherein each of the first wall and the bung are molded as a single unit which are subsequently joined together. One of the first wall and the bung may include a locating rib and the other of the first wall and the bung may include a locating recess and the locating rib and locating recess are adapted to cooperate together to position the bung with respect to the first wall. In addition to the locating rib and locating recess, the first wall and the bung may be secured using one or more of gluing, welding and screwing the parts together.

20 Claims, 7 Drawing Sheets

(56) References Cited

U.S. PATENT DOCUMENTS

| | | | |
|---|---|---|---|
| 5,572,800 | A | 11/1996 | West |
| 5,598,640 | A | 2/1997 | Schepisi |
| 5,628,123 | A | 5/1997 | Chan |
| 5,649,370 | A | 7/1997 | Russo |
| 5,681,630 | A | 10/1997 | Smick et al. |
| D398,074 | S | 9/1998 | Nosenchuck |
| 5,841,943 | A | 11/1998 | Nosenchuck |
| 5,875,562 | A | 3/1999 | Fogarty |
| 6,203,349 | B1 | 3/2001 | Nakazawa |
| 6,751,886 | B2 | 6/2004 | Chang et al. |
| 6,763,183 | B1 | 7/2004 | Huang |
| 6,889,445 | B1 | 5/2005 | Varona et al. |
| D550,813 | S | 9/2007 | Lammel et al. |
| D646,354 | S | 10/2011 | Gessi |
| 8,132,571 | B1 | 3/2012 | Jackson |
| D696,386 | S | 12/2013 | Schoenherr et al. |
| D702,322 | S | 4/2014 | Sieger |
| 2001/0048810 | A1 | 12/2001 | Cheng |
| 2002/0129512 | A1 | 9/2002 | Cheng |
| 2003/0079366 | A1 | 5/2003 | Chang |
| 2004/0083620 | A1 | 5/2004 | McCambridge et al. |
| 2004/0163274 | A1 | 8/2004 | Andrew et al. |
| 2004/0172847 | A1 | 9/2004 | Saida et al. |
| 2005/0229422 | A1 | 10/2005 | Mattinger et al. |
| 2006/0075654 | A1 | 4/2006 | Lin |
| 2007/0294909 | A1 | 12/2007 | Abdi et al. |
| 2008/0263887 | A1 | 10/2008 | Nakasone et al. |
| 2008/0271337 | A1 | 11/2008 | Chan |
| 2009/0052877 | A1 | 2/2009 | Cheng |
| 2010/0064542 | A1 | 3/2010 | Mulvaney et al. |
| 2010/0065545 | A1 | 3/2010 | Chung et al. |
| 2011/0079239 | A1 | 4/2011 | Hall |
| 2011/0099832 | A1 | 5/2011 | Bikhazi |
| 2011/0177711 | A1 | 7/2011 | Park |
| 2011/0203128 | A1 | 8/2011 | Rodrigues |
| 2013/0111777 | A1 | 5/2013 | Jeong |
| 2013/0239427 | A1 | 9/2013 | Quessard et al. |
| 2013/0269200 | A1 | 10/2013 | Moloney et al. |
| 2013/0269201 | A1 | 10/2013 | Courtney et al. |
| 2013/0276320 | A1 | 10/2013 | Courtney et al. |
| 2013/0276321 | A1 | 10/2013 | Courtney et al. |
| 2013/0283630 | A1 | 10/2013 | Courtney et al. |
| 2013/0283631 | A1 | 10/2013 | Moloney et al. |
| 2014/0007448 | A1 | 1/2014 | Courtney et al. |
| 2014/0007449 | A1 | 1/2014 | Courtney et al. |
| 2014/0290087 | A1 | 10/2014 | Weatherly |
| 2015/0026993 | A1 | 1/2015 | Sutter et al. |
| 2016/0206076 | A1 | 7/2016 | Stephens et al. |
| 2016/0206077 | A1 | 7/2016 | Stephens et al. |

FOREIGN PATENT DOCUMENTS

| | | |
|---|---|---|
| CN | 201328477 | 10/2009 |
| CN | 201341553 | 11/2009 |
| CN | 101292806 | 10/2010 |
| CN | 201774080 | 3/2011 |
| CN | 201879007 | 6/2011 |
| CN | 201948229 | 8/2011 |
| CN | 202146022 | 2/2012 |
| CN | 202436392 | 9/2012 |
| CN | 202536440 | 11/2012 |
| CN | 202774786 | 3/2013 |
| CN | 202874233 | 4/2013 |
| DE | 1 829 117 | 4/1961 |
| DE | 26 18 819 | 11/1977 |
| DE | 277 118 | 3/1990 |
| DE | 195 27 111 | 1/1997 |
| DE | 10 2009 049 838 | 4/2011 |
| EP | 0 105 810 | 4/1984 |
| EP | 0 284 690 | 10/1988 |
| EP | 0 300 281 | 1/1989 |
| EP | 0 306 765 | 3/1989 |
| EP | 0 970 633 | 1/2000 |
| EP | 1 433 401 | 8/2004 |
| EP | 1 616 500 | 1/2006 |
| EP | 2 000 042 | 12/2008 |
| EP | 2 255 692 | 12/2010 |
| EP | 2 392 223 | 12/2011 |
| EP | 2 401 939 | 1/2012 |
| EP | 2 869 726 | 5/2015 |
| FR | 1387334 | 1/1965 |
| FR | 1408096 | 8/1965 |
| GB | 647291 | 12/1950 |
| GB | 953057 | 3/1964 |
| GB | 1 446 385 | 8/1976 |
| GB | 1 456 000 | 11/1976 |
| GB | 1 489 723 | 10/1977 |
| GB | 1 539 485 | 1/1979 |
| GB | 2 295 056 | 5/1996 |
| GB | 2 316 868 | 3/1998 |
| GB | 2472240 | 2/2011 |
| GB | 2478927 | 9/2011 |
| GB | 2482547 | 2/2012 |
| GB | 2482548 | 2/2012 |
| GB | 2482549 | 2/2012 |
| GB | 2500798 | 10/2013 |
| GB | 2500800 | 10/2013 |
| GB | 2503684 | 1/2014 |
| GB | 2503685 | 1/2014 |
| GB | 2503686 | 1/2014 |
| GB | 2515813 | 1/2015 |
| GB | 2516478 | 1/2015 |
| JP | 41-22432 | 11/1966 |
| JP | 53-36991 | 3/1978 |
| JP | 55-218 | 1/1980 |
| JP | 55-79904 | 6/1980 |
| JP | 55-153002 | 11/1980 |
| JP | 56-26004 | 3/1981 |
| JP | 56-106103 | 8/1981 |
| JP | 60-135700 | 7/1985 |
| JP | 61-50507 | 3/1986 |
| JP | 63-83104 | 6/1988 |
| JP | 1-27506 | 1/1989 |
| JP | 1-29208 | 1/1989 |
| JP | 2-29603 | 2/1990 |
| JP | 4-221507 | 8/1992 |
| JP | 4-130705 | 11/1992 |
| JP | 5-7507 | 1/1993 |
| JP | 5-130915 | 5/1993 |
| JP | 5-176811 | 7/1993 |
| JP | 7-16113 | 1/1995 |
| JP | 7-155219 | 6/1995 |
| JP | 3014299 | 8/1995 |
| JP | 8-343 | 1/1996 |
| JP | 8-322633 | 12/1996 |
| JP | 2000-201723 | 7/2000 |
| JP | 2001-37530 | 2/2001 |
| JP | 2002-238649 | 8/2002 |
| JP | 2003-153731 | 5/2003 |
| JP | 2004-312 | 1/2004 |
| JP | 2004-113402 | 4/2004 |
| JP | 2004-208935 | 7/2004 |
| JP | 2004-283549 | 10/2004 |
| JP | 2004-293389 | 10/2004 |
| JP | 2004-357763 | 12/2004 |
| JP | 2005-546 | 1/2005 |
| JP | 2006-51181 | 2/2006 |
| JP | 2006-130181 | 5/2006 |
| JP | 2006-141490 | 6/2006 |
| JP | 2006-181265 | 7/2006 |
| JP | 2007-136121 | 6/2007 |
| JP | 2008-200429 | 9/2008 |
| JP | 2010-274050 | 12/2010 |
| JP | 2012-45178 | 3/2012 |
| JP | 2012-157382 | 8/2012 |
| JP | 2013-162830 | 8/2013 |
| KR | 20-0206074 | 12/2000 |
| KR | 20-2011-0002484 | 3/2011 |
| KR | 10-1372045 | 3/2014 |
| RU | 2 262 282 | 10/2005 |
| RU | 2 403 841 | 11/2010 |
| WO | WO-83/02753 | 8/1983 |
| WO | WO-94/23611 | 10/1994 |
| WO | WO-2004/006712 | 1/2004 |

(56) References Cited

FOREIGN PATENT DOCUMENTS

| | | |
|---|---|---|
| WO | WO-2005/120283 | 12/2005 |
| WO | WO-2007/043732 | 4/2007 |
| WO | WO-2008/053099 | 5/2008 |
| WO | WO-2012/059700 | 5/2012 |
| WO | WO-2012/069983 | 5/2012 |
| WO | WO-2012/076885 | 6/2012 |
| WO | WO-2014/001770 | 1/2014 |
| WO | WO-2014/006365 | 1/2014 |
| WO | WO-2014/147460 | 9/2014 |
| WO | WO-2015/001308 | 1/2015 |
| WO | WO-2015/001310 | 1/2015 |
| WO | WO-2015/011442 | 1/2015 |

OTHER PUBLICATIONS

Combined Search and Examination Report dated Jul. 20, 2015, directed to GB Application No. 1500977.2; 3 pages.

International Search Report and Written Opinion dated Feb. 1, 2016, directed to International Application No. PCT/GB2015/053578; 15 pages.

Reba, I. (1966). "Applications of the Coanda Effect," *Scientific American* 214:84-92.

Stephens et al., U.S. Office Action dated Oct. 5, 2017, directed to U.S. Appl. No. 15/003,685; 8 pages.

Stephens et al., U.S. Office Action dated Oct. 5, 2017, directed to U.S. Appl. No. 15/003,689; 8 pages.

Stephens et al., U.S. Office Action dated May 10, 2018, directed to U.S. Appl. No. 15/003,685; 10 pages.

Stephens et al., U.S. Office Action dated May 11, 2018, directed to U.S. Appl. No. 15/003,689; 7 pages.

ATTACHMENT FOR A HAND HELD APPLIANCE

REFERENCE TO RELATED APPLICATIONS

This application claims the priority of United Kingdom Application No. 1500977.2, filed Jan. 21, 2015, the entire contents of which are incorporated herein by reference.

FIELD OF THE INVENTION

This invention relates to an attachment for a handheld appliance, in particular it relates to an attachment for a hair care appliance such as a hairdryer.

BACKGROUND OF THE INVENTION

Removable attachments for hairdryer can have a number of different uses. The usually circular flow exiting the hairdryer can be concentrated and flattened using a concentrator nozzle/attachment or it can be expanded and slowed by a diffuser. The different types of attachment dry the hair at different speeds with different flow rates enabling different styles to be created.

The fluid flowing through the attachment is often heated causing the outer surface of the attachment to become uncomfortably hot to touch. It is desirable to mitigate any overheating whilst not impairing features of the hairdryer such as the thrust through the appliance and the noise produced during use. In addition it is desirable to have close control over the mitigation of any overheating so that undesirable features such as hot spots on the surface of the attachment do not occur.

SUMMARY OF THE INVENTION

According to one aspect, the invention provides an attachment for a hand held appliance, the attachment comprising an outer wall with a first part which is generally conical in shape, and a fluid inlet into the outer wall, wherein the fluid inlet is formed from a discontinuity in the outer wall.

Also provided is a hand held appliance comprising a handle and a body wherein an outer wall of the body decreases in diameter towards a front end of the body, a primary fluid flow path extending from a primary fluid inlet into the appliance to a primary fluid outlet for emitting the fluid flow from a front end of the body, a fan unit for drawing primary flow into the primary fluid inlet and an attachment, wherein the attachment comprises an outer wall formed from a first wall and a sleeve, the outer wall having a first part which is adapted at one end to connect with the appliance, wherein the first part is generally conical in shape, and the outer wall comprises a fluid inlet is formed from a discontinuity in the outer wall and wherein the outer wall of the first part of the attachment continues along substantially the same line as the body as the outer wall of the body decreases in diameter the towards the front end of the body.

Preferably, the outer wall is formed from a first wall and a sleeve. Preferably, the first wall defines a fluid flow path through the attachment. In a preferred embodiment, the sleeve extends around the first wall forming a second fluid flow path from the fluid inlet in the outer wall, the second fluid flow path extending between the first wall and the sleeve.

According to another aspect, the invention provides an attachment for a hand held appliance, the attachment comprises a first end and a second end, the attachment comprising a first wall extending from the first end and defining a fluid flow path through the attachment, a sleeve extending about the first wall and defining with the first wall a second fluid flow path through the attachment, the second fluid flow path comprising a fluid inlet formed between the first wall and the sleeve wherein an outer surface of the sleeve and an outer surface of the first wall are collinear.

Also disclosed is a hand held appliance comprising a handle and a body wherein an outer wall of the body decreases in diameter towards a front end of the body, a primary fluid flow path extending from a primary fluid inlet into the appliance to a primary fluid outlet for emitting the fluid flow from a front end of the body, a fan unit for drawing primary flow into the primary fluid inlet and an attachment, wherein the attachment comprises a first end which is adapted to connect with the appliance and a second end, the attachment comprising a first wall extending from the first end and defining a fluid flow path through the attachment, a sleeve extending about the first wall and defining with the first wall a second fluid flow path through the attachment, the second fluid flow path comprising a fluid inlet formed between the first wall and the sleeve wherein an outer surface of the sleeve and an outer surface of the first wall are collinear and continue along substantially the same line as the body as the outer wall of the body decreases in diameter the towards the front end of the body.

The outer surface of the attachment is formed from the sleeve and a part of the first wall. The fluid inlet is formed by a gap between the sleeve and the first wall.

Preferably, the fluid flow path extends from a first fluid inlet into the attachment to a first fluid outlet. The fluid flow path is defined by the first wall and extends within the first wall.

In a preferred embodiment, the first fluid inlet is annular. Preferably, the fluid flow path has a cross-sectional area that expands from the first fluid inlet towards the first fluid outlet.

Preferably, the attachment has a second part which is generally rectangular in shape and the cross-sectional area of the first fluid flow path contracts within the second part.

Preferably, the fluid inlet is formed with blended corners. Thus the edges defining the fluid inlet are not formed with sharp corners; they are rounded to encourage fluid to flow along the surfaces.

According to another aspect, is an attachment for a hand held appliance, the attachment comprising a first wall wherein the first wall defines a fluid flow path through the attachment extending from an annular first fluid inlet into the attachment to a first fluid outlet, characterised in that the fluid flow path has a cross-sectional area that expands from the first fluid inlet towards the first fluid outlet.

When fluid enters the attachment, the cross-sectional area of the fluid flow path increases from that of the annular first fluid inlet. This serves to slow down the flow which is advantageous as the flow direction is changed within the attachment to alter the flow profile from an annulus to the more concentrated outlet profile. By slowing the flow, the fluid is less likely to hit the walls of the attachment and more inclined to attach to the walls and follow the curves, which may reduce the generation of noise, may reduce the production of recirculation within the fluid flow path, and may produce more laminar flow.

Preferably, the attachment comprises a first part and a second part and the first part extends from the first fluid inlet towards the first fluid outlet and the second part extends from the first fluid outlet towards the first fluid inlet and wherein the cross-sectional area expands within the first part.

It is preferred that the first part is conical is shape.

Preferably, the second part is elliptical or generally rectangular in shape.

It is preferred that the annular first fluid inlet is formed from the first wall and a bung that extends within the first wall.

Preferably, within the second part the fluid flow path has a cross-sectional area that at least initially contracts. Thus as fluid moves from the first part to the second part, the cross sectional area of the attachment decreases or is reduced. The attachment has a fluid flow path that starts at the first fluid inlet cross sectional area—X, increases above X within the first part of the attachment and then decreases towards X within the second part, as fluid flowing within the fluid flow path moves towards the first fluid outlet.

It is preferred that the first fluid outlet has a cross-sectional area and within the second part, the cross-sectional area of the first fluid flow path contracts until it is the same as the cross-sectional area of the first fluid outlet.

As the flow profile is changed within the attachment a number of things occur. The flow is slowed down during the initial expansion and turned to form the outlet profile. This expansion and slowing of the flow causes thrust to be lost. By contracting the cross-sectional area once the flow has been turned the fluid is re-concentrated which increases the thrust of fluid that exits from the first fluid outlet of the attachment.

Preferably, the attachment comprises a sleeve wherein the sleeve extends over the first wall forming a fluid flow path through the attachment.

It is preferred that the second fluid flow path extends from a second fluid inlet formed between the sleeve and the first wall.

Also disclosed is a hair care appliance comprising a handle and a body, a primary fluid flow path extending from a primary fluid inlet into the appliance to an annular primary fluid outlet for emitting the fluid flow from a front end of the body, a fan unit for drawing primary flow into the primary fluid inlet and an attachment, the attachment comprising a first wall wherein the first wall defines a fluid flow path through the attachment extending from an annular first fluid inlet into the attachment to a first fluid outlet, wherein, in use the annular first fluid inlet is in fluid communication with the annular primary fluid outlet, characterised in that the fluid flow path has a cross-sectional area that expands from the first fluid inlet towards the first fluid outlet.

Preferably, the attachment has a cross sectional area that is greater than that of the annular primary fluid outlet.

A further aspect of the invention provides an attachment for a hand held appliance, the attachment having a first wall and a bung housed within the first wall wherein each of the first wall, the sleeve and the bung are moulded as a single unit which are subsequently joined together.

It is preferred that one of the first wall and the bung comprises a locating rib and the other of the first wall and wherein the bung comprises a locating recess and the locating rib and locating recess are adapted to cooperate together to position the bung with respect to the first wall.

Preferably, in addition to the locating rib and locating recess, the first wall and the bung are secured using one or more of gluing, welding and screwing the parts together.

Preferably, the attachment comprises a fluid flow path extending between the first wall and the bung. It is preferred that the fluid flow path extends from a first fluid inlet into the attachment. Preferably, the first fluid inlet is annular.

It is preferred that the attachment further comprises a sleeve extending about the first wall.

Preferably, the sleeve is moulded as a single unit and is subsequently joined with the first wall.

It is preferred that the first wall comprises at least one protrusion extending towards the sleeve.

Preferably, the sleeve comprises at least one cooperating protrusion extending towards the first wall.

It is preferred that the at least one protrusion and the at least one cooperating protrusion cooperate together when the sleeve and the first wall are assembled to provide a defined position for the sleeve with respect to the first wall.

Preferably, at least one of the at least one protrusion and the at least one cooperating protrusion comprises a locating feature which locates the sleeve with respect to the first wall in the defined position.

It is preferred that the attachment has a first part and a second part, wherein the first part is conical and the second part is generally elliptical.

Preferably, the at least one protrusion and the at least one cooperating protrusion are located in the first part of the attachment.

It is preferred that the attachment comprises a second fluid flow path extending between the first wall and the sleeve.

Preferably, the second fluid flow path extends from a fluid inlet formed between the first wall and the sleeve.

Also disclosed is a hand held appliance comprising an attachment according to any preceding claim. The hand held appliance is preferably a hair care appliance and more preferably a hairdryer.

A further aspect of the invention provides a hair care appliance comprising a handle and a body, a primary fluid flow path extending from a primary fluid inlet into the appliance to a primary fluid outlet for emitting the fluid flow from a front end of the body, a fan unit for drawing primary flow into the primary fluid inlet and an attachment, the attachment having a first wall and a bung housed within the first wall wherein each of the first wall and the bung are moulded as a single unit which are subsequently joined together wherein the attachment comprises a fluid flow path extending between the first wall and the bung and, when the attachment is attached to the appliance, the fluid flow path is in fluid communication with the primary fluid outlet.

Preferably, the primary fluid outlet is annular.

Preferably, the attachment comprises a sleeve extending about the first wall and a second fluid flow path extending between the first wall and the sleeve wherein the second fluid flow path extends from a fluid inlet formed between the first wall and the sleeve.

Preferably, the hair care appliance is a hairdryer. Alternatively, the hair care appliance is a hot styling appliance.

BRIEF DESCRIPTION OF THE DRAWINGS

The invention will now be described, by way of example only, with reference to the accompanying drawings, in which.

DETAILED DESCRIPTION OF THE INVENTION

Figure 1:
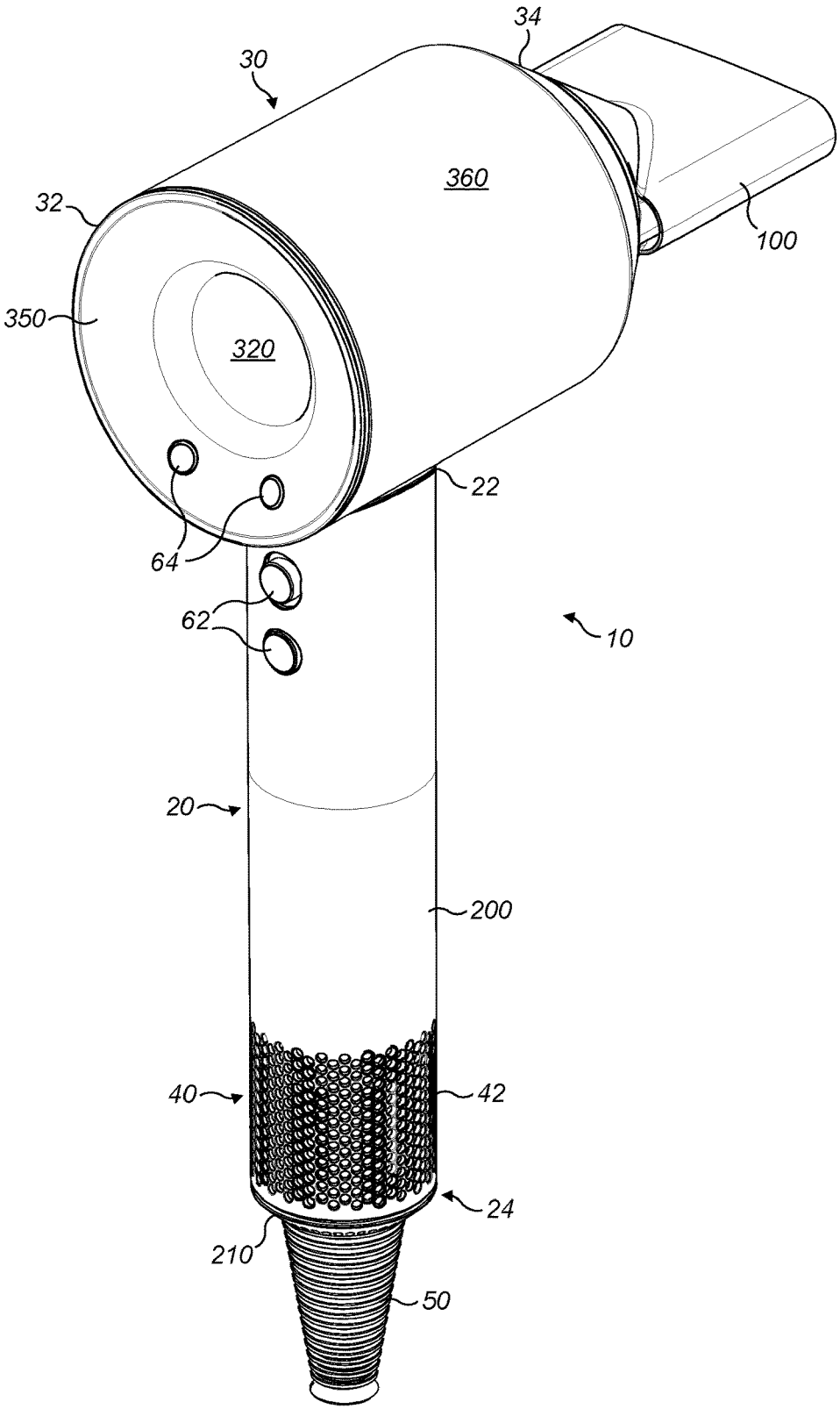
FIG. 1 shows a hairdryer and attachment according to the invention.
Figure 2:
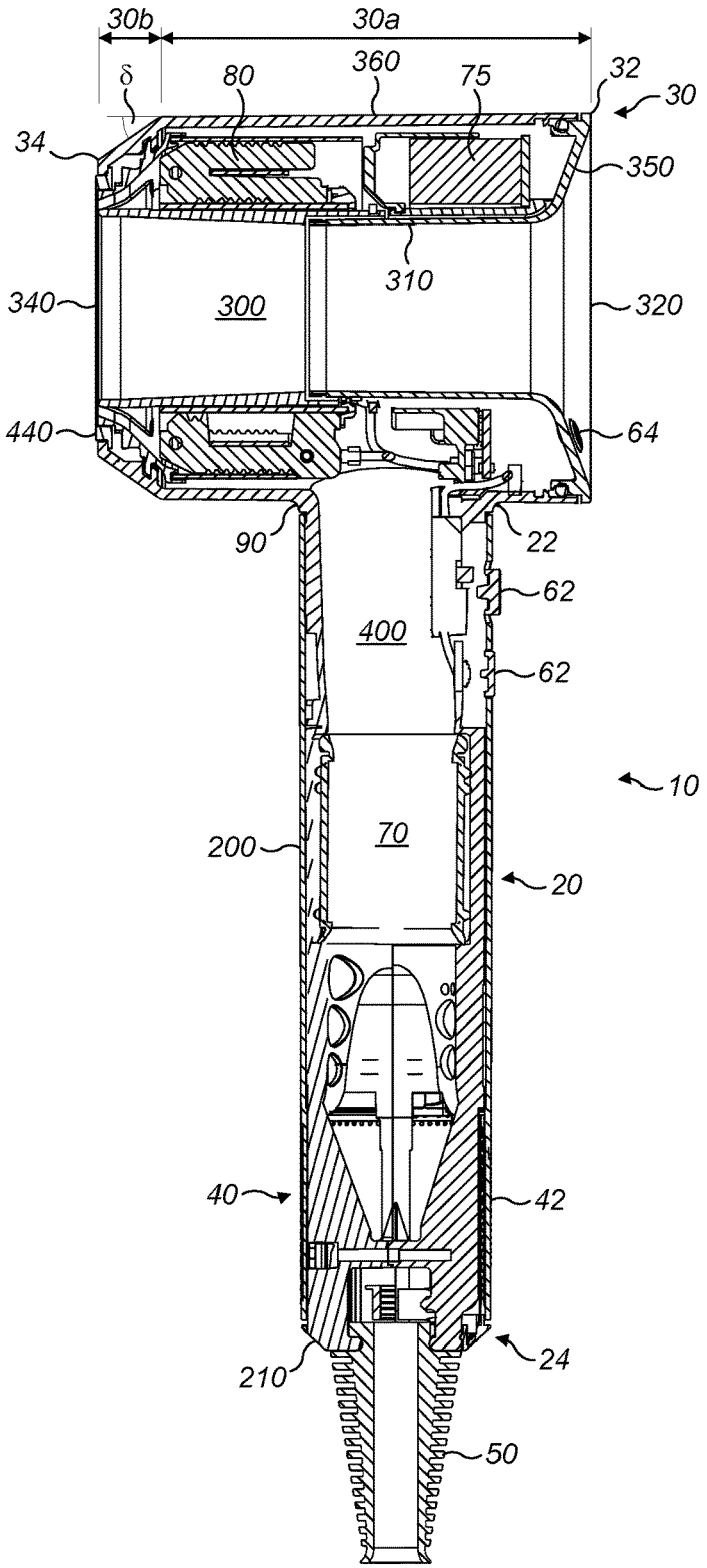
FIG. 2 shows a cross section through the hairdryer of FIG. 1.

FIGS. 1 and 2 show a hairdryer 10 with a handle 20 and a body 30. An attachment 100 is connected to the hairdryer 10 in FIG. 1. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle. The cable 50 is located approximately in the middle of the end wall 210 so extends from the centre of the handle 20.

Upstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 controls parameters such as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

Figure 3:
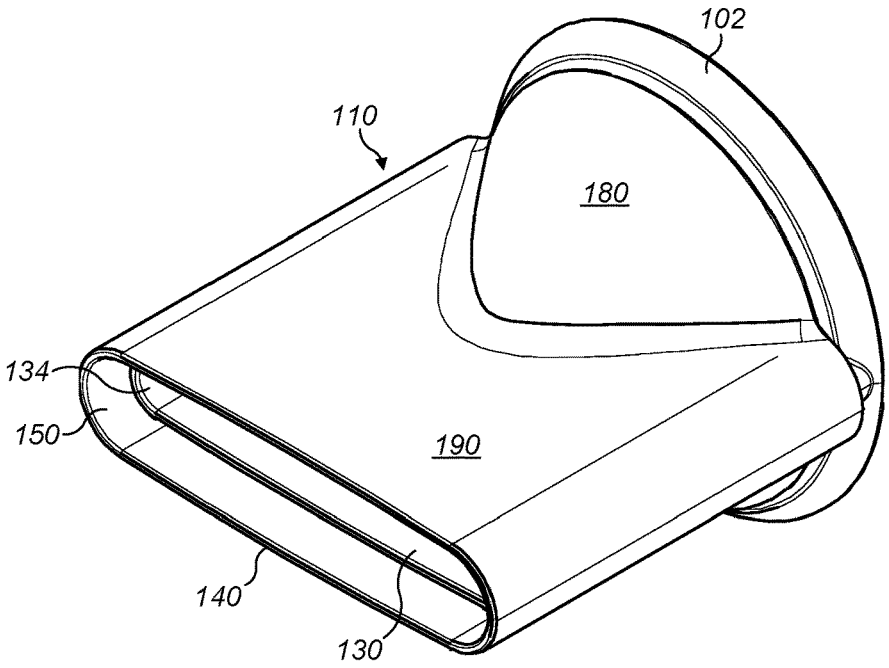
FIG. 3 is a front isometric view of an attachment according to the invention.
Figure 4:
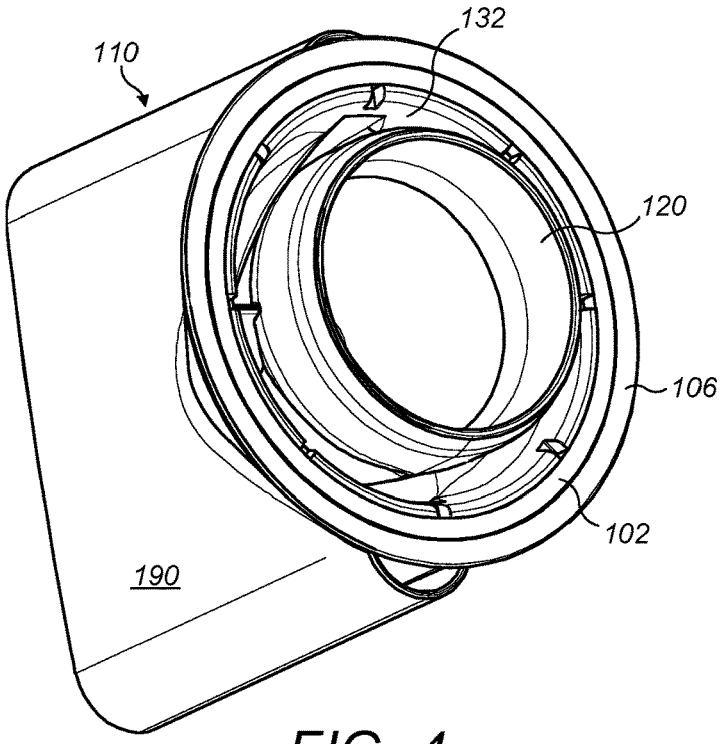
FIG. 4 is a rear isometric view of an attachment according to the invention.
Figure 5A:
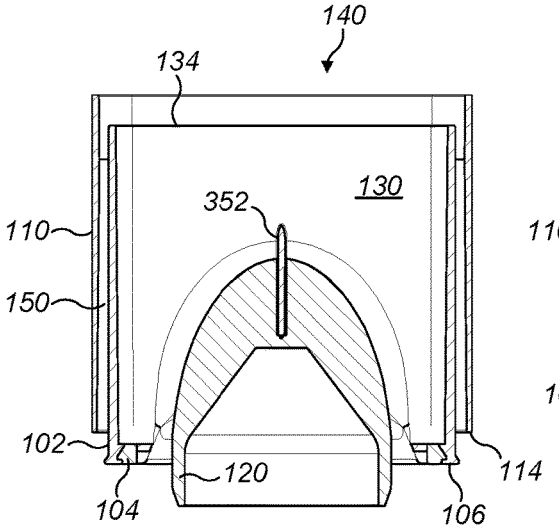
FIGS. 5*a* and 5*b* are cross sections through a top view of the attachment.
Figure 5B:
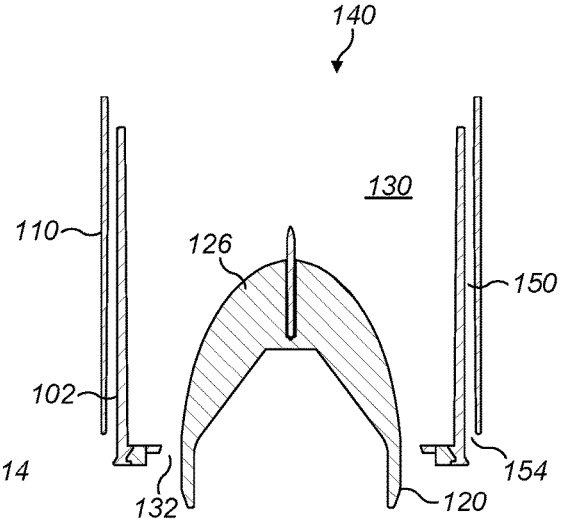

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 3*a*, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

The body 30 of the hairdryer 10 decreases in diameter towards the second end 34. This decrease in diameter has a constant gradient. The body 30 has a first part 30*a* which is generally tubular and extends from the first end 32 and a second part 30*b* which is conical and extends from a downstream end of the first part 30*a* to the second end 34; thus, the outer wall 360 of the body decreases in diameter towards a front end of the body. The angle δ subtended by the second part 30*a* in this example is around 30°.

The attachment 100 will now be described in more detail with particular reference to FIGS. 1 and 3 to 8*b*. The attachment 100 is a concentrator nozzle which attaches to the second end 34 of the hairdryer 10. The attachment 100 has a first part 180 and a second part 190. The first part 180 attaches to the second end 34 of the hairdryer 10 and is conical. The second part 190 extends from the first part 180 towards a fluid outlet 140 from the attachment 100 and is generally elliptical or rectangular with rounded corners. This shape change concentrates the circular or annular flow from the hairdryer 10 to a more focused area.

Figure 6:
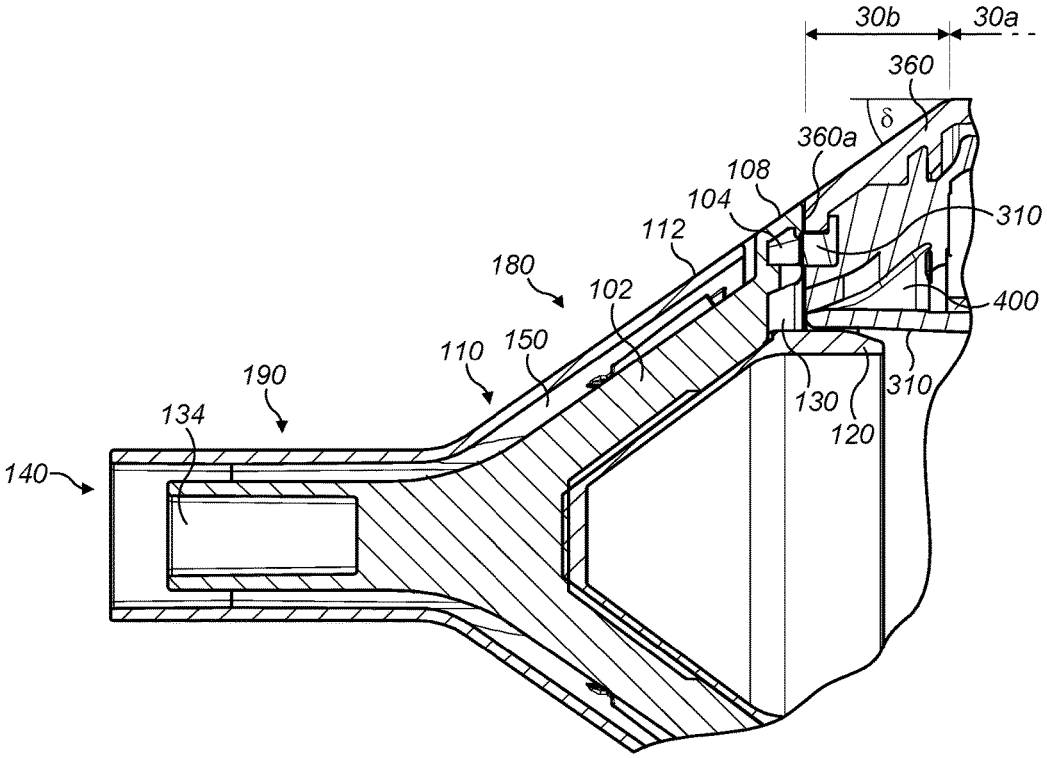
FIG. 6 is a side cross section through the attachment when attached to the hairdryer.
Figure 7A:
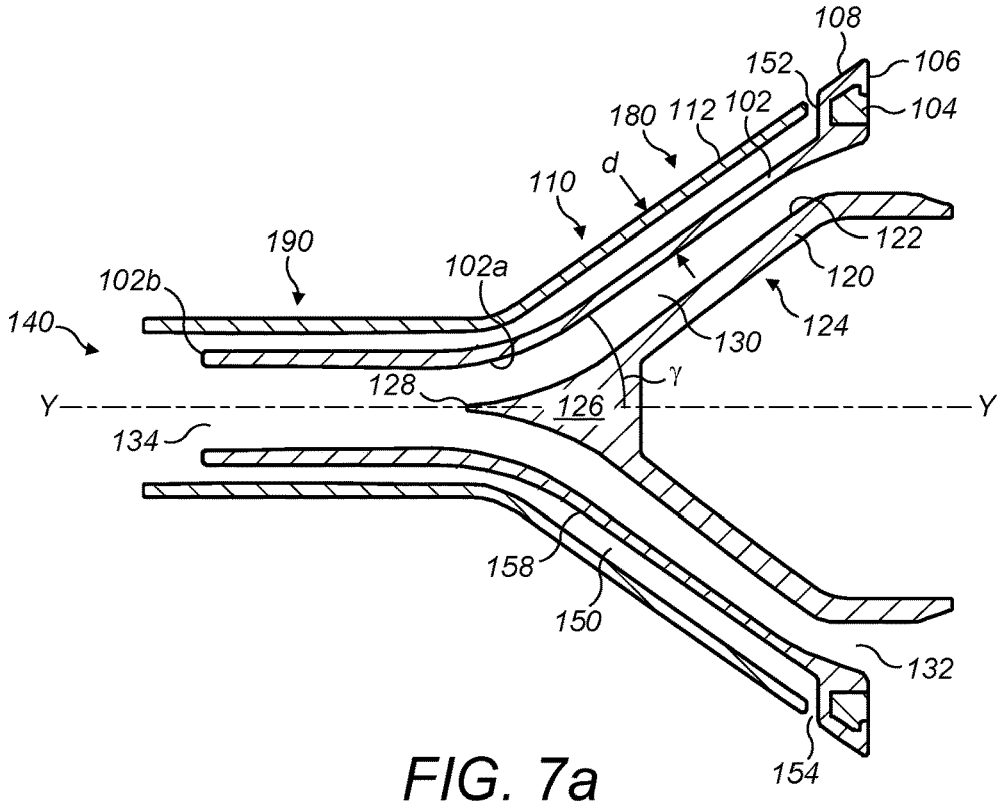
FIG. 7*a* is a simplified cross section through the attachment.
Figure 7B:
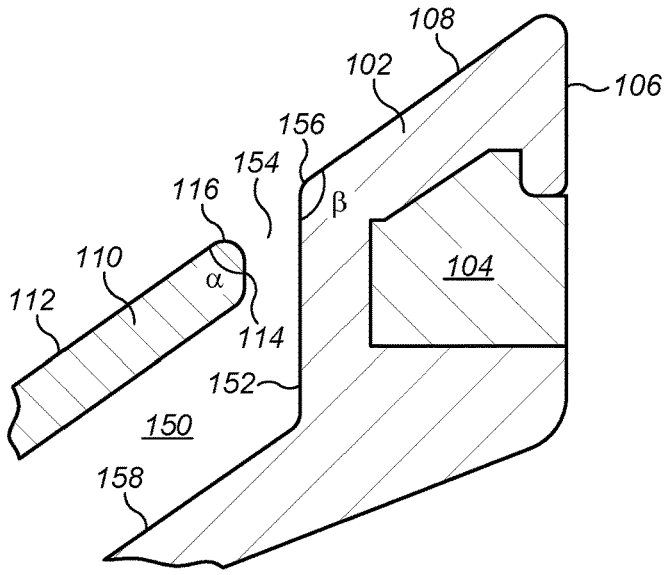
FIG. 7*b* is an enlarged view of the fluid inlet into the attachment.

In this example, the attachment 100 includes a first wall 102, a sleeve 110 and a bung 120. Referring to FIG. 6, the first wall 102 engages with a front face 360*a* of the outer wall 360 of the hairdryer 10. Magnets 370 are provided in the front face 360*a* of the outer wall 360 which engage with magnetic material 104 that extends around a mating face 106 of the first wall 102.

There are two fluid flow paths through the attachment 100, however these do not correspond to the two fluid flow paths through the hairdryer 10. A first fluid flow path 130 extends within the first wall 102 and is in fluid communication with the primary fluid outlet 440 of the hairdryer 10, thus this first fluid flow path 130 can contain heated fluid. Any hot fluid will heat up the first wall 110 and the magnetic material 104 housed in the first wall 110. The first fluid flow path 130 has a first fluid inlet 132 into the attachment 100 and a first fluid outlet 134.

A second fluid flow path 150 is formed between the first wall 102 and the sleeve 110. The second fluid flow path 150 has a second fluid inlet 154 into the attachment 100 and extends to the fluid outlet 140 of the attachment 100. This second fluid flow path 150 takes fluid from outside the hairdryer 10 and provides an insulating layer of fluid that takes heat from the first wall 102 to prevent the attachment 100 from getting too hot to touch if a user wishes to remove the attachment 100 from the hairdryer 10.

The sleeve 110 extends around the first wall 102 for the whole of the second part 190 of the attachment 100 and the majority of the first part 180 and is spaced from the first wall 102. In this example, the sleeve 110 extends beyond the first wall 102 at the fluid outlet 140.

The first part 180 of the attachment 100 is conical and is formed from an outer face 108 of the first wall 102 and an outer face 112 of the sleeve 110. Both of the outer face 108 of the first wall 102 and the outer face 112 of the sleeve 110 follow a line described by the second end 34 of the hairdryer 10. Thus, as the body 20 of the hairdryer 10 decreases in diameter towards the second end 34, the attachment also decreases in diameter over the first part 180. This decrease, as with the body 30 of the hairdryer 10, is of a constant gradient. The outer face 108 of the first wall 102 and the outer face 112 of the sleeve 110 are collinear. The angle δ subtended by the outer face 108 of the first wall 102 and the outer face 112 of the sleeve 110 in this example is around 30°. It is the same as the angle δ subtended by the second part 30*b* of the body 30 of the hairdryer 10.

The outer face 108 of the first wall 102 extends from the mating face 106 towards the fluid outlet 140 of the attachment 100, initially matching the gradient of the second end 34 of the hairdryer 10. After a short distance, the first wall 102 turns towards a central axis Y-Y of the attachment 100 producing a side wall 152. This side wall 152 forms part of a second fluid inlet 154 into the attachment 100. The side wall 152 is substantially orthogonal to the central axis Y-Y of the attachment 100 except at the junction 156 between the outer face 108 of the first wall 102 and the side wall 152 which has a blended corner with an internal angle β which is greater than 90°. Downstream of the side wall 152 is an inner wall 158, this inner wall 158 is approximately parallel to the sleeve 110, the distance d between the inner wall 158 and the sleeve is 1-3 mm and is constant along the first part 180 of the attachment 100.

The sleeve 110, and in particular an upstream face 114 of the sleeve 110 forms the other part of the second fluid inlet 154. This upstream face 114 is also substantially orthogonal to the central axis Y-Y of the attachment 100 apart from the junction 116 of the outer face 112 of the sleeve 110 with the upstream face 114 which has a blended corner with an internal angle α which is less than 90°. By having β>α fluid that is drawn into the second fluid inlet 154 attaches to the side wall 152 which improves the heat removal from the magnetic material 104. This is advantageous as the magnetic material tends to heat up more quickly than the surrounding attachment material which in this case is a plastic material.

The distance between the side wall 152 and the upstream face 114 is approximately 1 mm. This has been found to allow sufficient flow of fluid through the second fluid flow path 150 to cool the attachment 100.

The first fluid flow path 130 extends within the first wall 102. The first fluid flow path 130 accepts fluid from the primary fluid flow path 400 of the hairdryer 10. As the primary fluid outlet 440 is annular, the first fluid inlet 132 is annular. The bung 120 is provided to block the fluid flow path 300 and to guide fluid exiting the primary fluid flow path 400 through the attachment 100 as the flow profile changes from annular at the first fluid inlet 132 to elliptical or generally rectangular at the first fluid outlet 134.

The bung 120 is circular at one end and this end is adapted to be inserted into the inner duct 310. Within the first part 180 of the attachment, the bung 120 is also cone shaped then as the attachment transitions into the rectangular shape, the bung 120 flattens and narrows matching the shape change of the first wall 102. This provides a smooth transition of the primary flow from an annular flow profile to a substantially rectangular profile.

Figure 9:
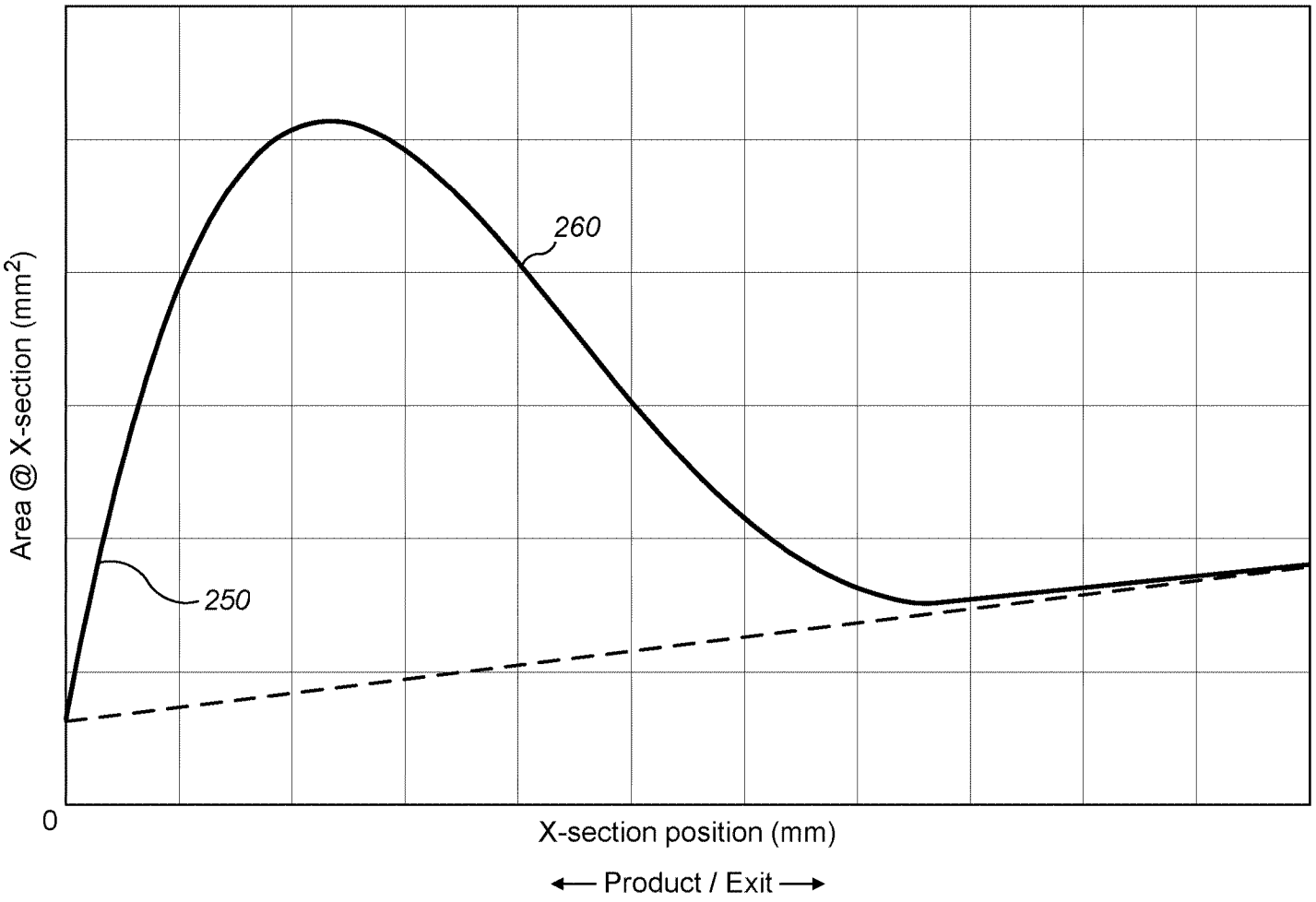
FIG. 9 shows a graph of variation in cross-sectional area through the first fluid flow path.

In order to provide maximum thrust at the fluid outlet 140 of the attachment 100 and to minimise pressure loss produced by the restriction formed in the attachment 100, the cross-sectional area within the first fluid flow path 130 is non-constant. Referring now to FIG. 9 in particular, fluid exiting the primary fluid outlet is at high velocity and it is desirable to focus this flow without losing momentum or producing noise. When the fluid exits the primary fluid outlet 440 and enters the first fluid flow path 130, the cross-sectional area is increased 250. This causes the fluid to slow or reduce in velocity, encourages the flow to stick to the walls and turn down the path. There is less recirculation of fluid and by slowing the flow down there are less pressure losses from non-laminar flow hitting the walls.

Once the fluid has been turned around the corner produced by the bung 120 and the first wall 102, the cross-sectional area of the first fluid flow path is reduced 260. This corresponds approximately with the end of the bung 120. Reducing the cross-sectional area increases the velocity of the fluid enabling maximisation of thrust from the fluid outlet 140 of the attachment 100.

Reduction of the production of noise is from the shape of the bung 120. A first part of the bung 124 is conical and matches the profile of the first wall 102 and is the part that turns the fluid from an annular flow to a laminar flow from a substantially rectangular fluid outlet 14. A second part of the bung 126 is downstream of the first part of the bung 124 and flattens to a line profile 128. Two important features that reduce the production of noise are the angle of an inner face 102*a* the first wall 102 with respect to the central axis Y-Y of the attachment 100. An angle γ of around 35° is beneficial to both thrust and acoustics. In addition the distance between the line profile 128 of the bung and the downstream end 102*b* of the first wall 102 should be 10 to 30 mm, preferably around 20 mm. Also, it has been found that the exit area of the first fluid outlet 134 impacts the thrust from the attachment 100. For this attachment a first fluid outlet of 340-350 $mm^2$ has been found to maximise thrust.

In addition to assisting with noise, the bung 120 flattening down with a duck billed shape to a line profile 128 produces more even flow from the outlet 140. Often concentrator nozzles have uneven flow, with more flow at each side of the generally rectangular shape, whereas having the bung profile which smoothly transitions from conical through a duck bill to an edge provides much more even flow across the whole of the fluid outlet.

Of course, the skilled person will appreciate that these figures and dimensions apply to this attachment 100 on this hairdryer 10 variations will be required for alternative schemes.

Figure 8A:
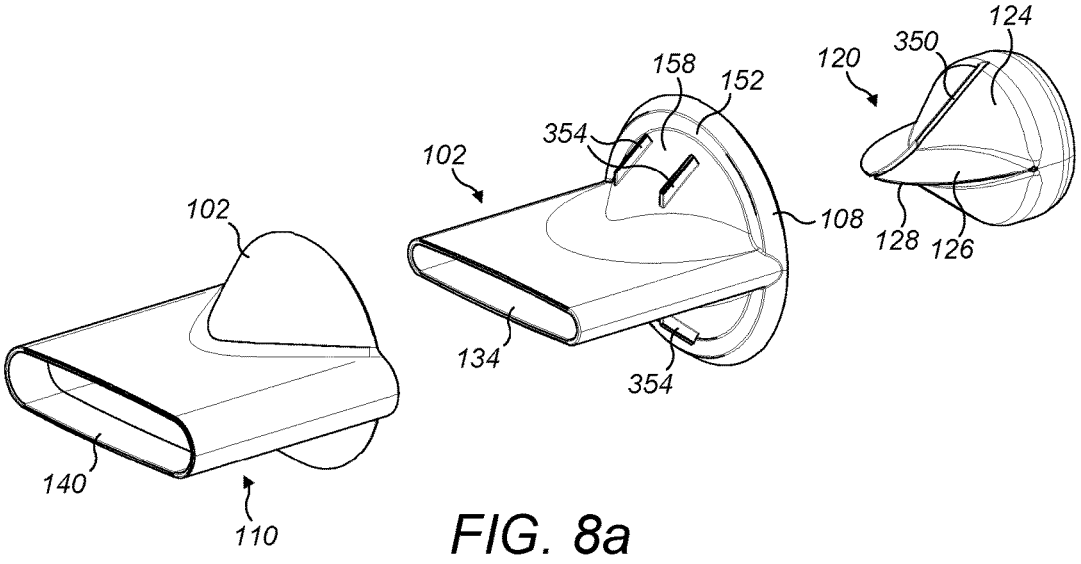
FIG. 8*a* is a front exploded isometric view of the attachment.
Figure 8B:
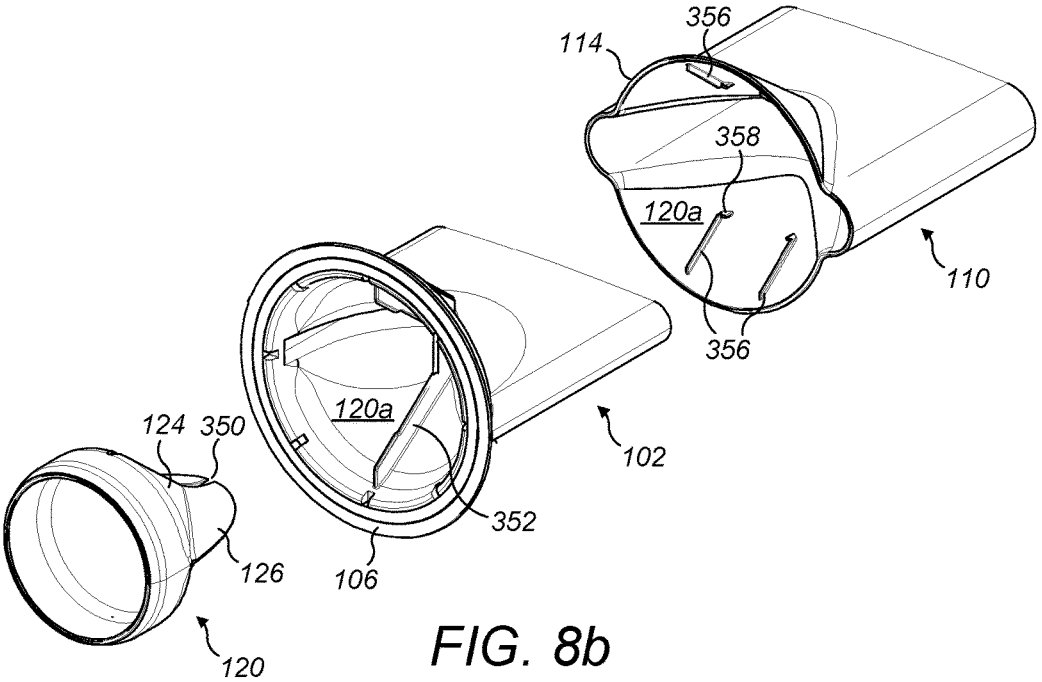
FIG. 8*b* is a rear exploded view of the attachment.

Referring in particular to FIGS. 8*a* and 8*b*, the construction of the attachment 100 will now be discussed. It is desirable to minimise connection points between each of the bung 120 with the first wall 102 and the first wall 102 with the sleeve 110 as each point or line of contact causes disturbance to flow and possibly a route for heat transfer to the sleeve 110. In order to mitigate this, the separate parts of the attachment 100 are ultrasonically welded along welding ribs.

The bung 120 comprises a slot 350 that extends along the first part 124 and the second part 126 to the line profile 128 on both sides of the bung 120. This slot 350 is orthogonal to the flattened duck billed part of the bung 120 and the line profile 128. The slot 350 is adapted to cooperate with and receive a "U-shaped" rib 352 extending from the inner face 102*a* of the first wall 102. Once the rib 352 is correctly inserted into the slot 350, the two parts are ultrasonically welded. As an alternative, the two parts are glued or screwed together.

The inner wall 158 of the first wall 102 comprises two pairs of ribs 354, one pair located on each side of the cone portion of the first wall 102. These two pairs of ribs 354 are ideally spaced from the rib 352 and slot 350 so there is not a clear heat transfer path through the attachment 100. A further set of two pairs of ribs 356 are located on the inner surface 120*a* of the sleeve 120. This further set of two pairs of ribs 356 each have a locating feature 358 to ensure that the two pairs of ribs 354 of the first wall 102 are housed between the further set of two pairs of ribs 356 of the sleeve 102. This helps to maintain concentricity of the sleeve 102 and the first wall 110 which reduces the chance of hot spots due to a variation in the distance between the sleeve 110 and the first wall 102. The locating feature 358 defines the position of the sleeve 102 with respect to the first wall 110. Once the various pairs of ribs are correctly aligned, the sleeve and first wall are ultrasonically welded. As an alternative, the two parts are glued or screwed together.

By having the construction features only located on the first part 180 of the attachment 100, the disruption to flow is minimised; and the risk of heat transfer is reduced. By moulding the sleeve from one part, unsightly mould lines of the more traditional two-part piece are removed. In addition, a user is more likely to hold the attachment by the second part 190 as this part is easier to grip. By restricting the construction features to being within the first part 180 there are no regions where the sleeve 102 and the first wall 110 contact within the second part 190 so there is no direct heat transfer path.

The positioning of the different parts of the attachment with respect to each other is important as the sleeve 102 and the first wall 110 define a second fluid inlet 154 into the attachment and the first wall 110 together with the bung 120 define a first fluid inlet 132 into the attachment. Any non-concentricity between any of the different parts will result in uneven flow, hot spots and possibly a reduction in the life of the attachment and hairdryer to which it is attached in use.

The invention has been described in detail with respect to a hairdryer and a hot styling appliance however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object that the output is directed at, for example, hair and the styling of that hair.

The attachment has been described with a cool wall sleeve, however this sleeve is not essential to all embodiments herein described. For example, the same construction method is applicable for an attachment comprising the bung and the first wall; obviously the attachment ribs 354 are unnecessary if there is no sleeve. In addition, the concept of initially expanding the cross-sectional area of the fluid flow path as fluid enters the attachment is valid for any attachment that has a change in flow direction from the hairdryer to the attachment outlet.

The attachment described has been described with respect to an amplifying hairdryer, again it will be apparent to the skilled person that this is an optional feature. The attachment described may be used with a conventional single fluid outlet hairdryer; the attachment described herein is useable with such a conventional hairdryer with or without the bung feature. Obviously the bung would not require insertion into a duct; it would require to be flush with or recessed within the end of the attachment that attaches to the conventional hairdryer.

The attachment described is attached to the hairdryer using magnetic attraction. Again, this is not essential to the invention and alternative connection methods such as snap fit, friction fit and rotational securement of the attachment to the hairdryer are equally applicable.

The invention is not limited to the detailed description given above. Variations will be apparent to the person skilled in the art.

The invention claimed is:

1. An attachment for a hand held appliance, the attachment having an inlet end for attachment to the hand held appliance, a first wall that decreases in size from a larger end of the first wall to a smaller end of the first wall, the larger end of the first wall being located at the inlet end of the attachment and configured to interface with the hand held appliance for attachment to the hand held appliance, a bung housed within the first wall, wherein the bung decreases in size from a larger end of the bung to a smaller end of the bung and the larger end of the bung is located at the inlet end, and an annular first fluid inlet to the attachment that is defined by the larger end of the bung and the larger end of the first wall, wherein each of the first wall and the bung are moulded as a single unit and subsequently joined together, and wherein the bung is configured to prevent fluid from flowing through the bung to block a central fluid flow path from the hand held appliance.

2. The attachment of claim 1, wherein one of the first wall and the bung comprises a locating rib and the other of the first wall and the bung comprises a locating recess and wherein the locating rib and locating recess are adapted to cooperate together to position the bung with respect to the first wall.

3. The attachment of claim 2, wherein in addition to the locating rib and locating recess, the first wall and the bung are secured using one or more of gluing, welding and screwing the parts together.

4. The attachment of claim 1, wherein the attachment comprises a fluid flow path extending between the first wall and the bung.

5. The attachment of claim 4, wherein the fluid flow path extends from the first fluid inlet into the attachment.

6. The attachment of claim 1, wherein the attachment further comprises a sleeve extending about the first wall.

7. The attachment of claim 6, wherein the sleeve is moulded as a single unit and is subsequently joined with the first wall.

8. The attachment of claim 6, wherein the attachment comprises a second fluid flow path extending between the first wall and the sleeve.

9. The attachment of claim 8, wherein the second fluid flow path extends from a second fluid inlet formed between the first wall and the sleeve.

10. The attachment of claim 7, wherein the first wall comprises at least one protrusion extending towards the sleeve.

11. The attachment of claim 10, wherein the sleeve comprises at least one cooperating protrusion extending towards the first wall.

12. The attachment of claim 11, wherein the at least one protrusion and the at least one cooperating protrusion cooperate together when the sleeve and the first wall are assembled to provide a defined position for the sleeve with respect to the first wall.

13. The attachment of claim 12, wherein at least one of the at least one protrusion and the at least one cooperating protrusion comprises a locating feature which locates the sleeve with respect to the first wall in the defined position.

14. The attachment of claim 11, wherein the attachment has a first part and a second part, wherein the first part is conical and the second part is generally elliptical.

15. The attachment of claim 14, wherein the at least one protrusion and the at least one cooperating protrusion are located in the first part of the attachment.

16. A hand held appliance comprising the attachment of claim 1.

17. A hair care appliance comprising the attachment of claim 1.

18. A hairdryer comprising the attachment of claim 1.

19. A hair care appliance comprising: a handle and a body, a primary fluid flow path extending from a primary fluid inlet into the appliance to a primary fluid outlet for emitting a primary fluid flow in the primary fluid flow path from a front end of the body, a fan unit for drawing the primary fluid flow into the primary fluid inlet and an attachment, the attachment having an inlet end attached to the front end of the body and comprising:

a first wall that decreases in size from a larger end of the first wall to a smaller end of the wall, the larger end of the first wall being located at the inlet end of the attachment and configured to interface with the hand held appliance for attachment to the hand held appliance, a bung housed within the first wall, wherein the bung decreases in size from a larger end of the bung to a smaller end of the bung, the larger end of the bung is located at the inlet end, and the bung is configured to prevent fluid from flowing through the bung, and an annular first fluid inlet to the attachment that is defined by the larger end of the bung and the larger end of the first wall, wherein each of the first wall and the bung are moulded as a single unit and subsequently joined together, and wherein the attachment comprises a fluid flow path extending between the first wall and the bung and, when the attachment is attached to the appliance, the fluid flow path is in fluid communication with the primary fluid outlet and the bung blocks a central flow path of the hair care appliance.

20. The appliance of claim 19, wherein the attachment comprises a sleeve extending about the first wall and a second fluid flow path extending between the first wall and the sleeve, and wherein the second fluid flow path extends from a second fluid inlet formed between the first wall and the sleeve.

* * * * *